United States Patent [19]

Waldock et al.

[11] Patent Number: 4,957,569

[45] Date of Patent: Sep. 18, 1990

[54] BINDING ADDITIVE FOR EXPLOSIVE COMPOSITIONS

[75] Inventors: Kevin H. Waldock, Mount Thorley; Daniel A. Wasson, Singleton, both of Australia

[73] Assignee: CBS Explosives Pty Limited, New South Wales, Australia

[21] Appl. No.: 271,715

[22] Filed: Nov. 16, 1988

[30] Foreign Application Priority Data

Nov. 18, 1987 [AU] Australia ..... PI5548

[51] Int. Cl.[5] ..... C06B 45/02

[52] U.S. Cl. ..... 149/21; 149/2; 149/46; 149/60; 149/61; 149/83

[58] Field of Search ..... 149/2, 21, 46, 60, 61, 149/83

[56] References Cited

U.S. PATENT DOCUMENTS 4,181,546 1/1980 Clay ..... 149/21

4,875,950 10/1989 Waldock et al. ..... 149/21

*Primary Examiner*—Stephen J. Lechert, Jr.

*Attorney, Agent, or Firm*—Birch, Stewart, Kolasch & Birch

[57] ABSTRACT

This invention relates to a dry mix explosive composition wherein a binding or holding agent is provided to hold the parts thereof together in a straightforward and efficient manner, in order to avoid segregation of the parts such as during mixing, placement and the like. The dry mix explosive composition includes oxidiser, fuel and bulking agent, and further includes a binder in the form of a water-in-oil emulsion which acts to hold the parts of said composition together during mixing, placement and the like.

4 Claims, No Drawings

BINDING ADDITIVE FOR EXPLOSIVE COMPOSITIONS

BACKGROUND TO THE PRESENT INVENTION

This invention relates to explosive compositions and in particular to dry mix explosive compositions such as ANFO explosive compositions.

Up until this time dry mix explosive compositions have been known and used, which generally comprise a mixture of oxidiser and fuel. Initially, composite explosives based on ammonium nitrate and a fuel sensitiser were known, but thereafter there were a number of developments for example using an oxidiser with nitrate salts added (for economic reasons), and with fuel portions including other liquids such as various grades of fuel oil, alcohols, paraffin, and nitrated paraffins. Further, other additives have often been added such as molecular explosives (TNT or smokeless powder). Further, combinations of different powdered fuels have been used to replace liquid fuels.

In dry mix compositions used up until this time, it has been common to use bulking agents such as for example to increase the density and effectiveness and performance of such explosive compositions. Such bulking agents which have been used up until this time are for example sawdust, foamed polystyrene beads or particles, vermiculite, and perlite. In addition, a bulking agent has recently been developed for use with dry mix explosive compositions, wherein the bulking agent includes vegetable protein matter, this bulking agent having particular advantages over other forms of bulking agent, as described and claimed in our copending patent application. Such a vegetable protein bulking agent can for example be chopped vegetable protein matter such as for example vegetable protein matter in the form of legumes, such as nuts, nutshells, peanut shells and walnut shells. These are by way of example only however. Throughout the specification and claims these additives will be referred to as "bulking agents", being additives or bulking agents which are added to the dry mix explosive composition, although it should be appreciated that the above are examples only of bulking agents and that the invention has equal application to other bulking agents or additives.

It has been found that one problem with dry mix explosive compositions, is that the parts thereof tend to segregate, such as for example during mixing and placement prior to detonation. Given the dry mix nature of such explosive compositions, it has been found that during mixing and placement of the parts of the composition, including the mixing of bulking agent, certain parts are lost such as for example by being blown away by the wind, by spillage and the like. This affects the effectiveness of the explosive and is expensive and generally inefficient.

It is an object of this invention to go at least some way towards overcoming or minimising these problems.

It is a further object of this invention to provide an efficient dry mix explosive composition.

Other objects of this invention will become apparent from the following description.

SUMMARY OF THE PRESENT INVENTION

According to one aspect of this invention there is provided a dry mix explosive composition, including:

oxidiser
fuel
bulking agent, and
binder in the form of a water-in-oil emulsion.

Another aspect of the invention is to provide a dry mix explosive composition, including: 50–72% (by weight) ammonium nitrate; 2–4% (by weight) fuel oil; 10–15% (by weight) bulking agent and 15–20% (by weight) of a water-in-oil emulsion, comprising a water-based solution of oxidizer salts held in a disperse phase in oil.

DETAILED DESCRIPTION OF THE INVENTION

This invention will now be described by way of example only, and it should be appreciated that modifications and improvements may be made to the invention without departing from the scope or spirit thereof.

As referred to, it has been a problem up until this time with dry mix explosive compositions, that when they are mixed and placed, parts thereof are often lost, separated or segregated, for example by spillage or by being blown away by the wind. As will be appreciated, the parts of the compositions are important to the effective detonation of the explosive composition, and thus by having parts of the composition separated or segregated, this detracts from the overall operation and efficiency of the composition.

In particular, where bulking agents (as hereinbefore defined) are used, there is always a substantial risk that such parts of the explosive composition will become segregated during mixing, storage or placement. For example, where the bulking agents are in the form of sawdust, foamed polystyrene particles or beads, vermiculite, perlite or vegetable protein matter, and such bulking agents are mixed, together with other parts of the composition, any exposure to wind, agitation, draft or the like can cause the particles (or at least some of the particles) to be separated or blown away. Further, once the particles have been mixed and the explosive composition is being inserted into a blast hole, further risks of segregation exist. As the composition is being placed or passed into a blast hole, certain of the parts or particles may for example be lost or blown away (for example blown out of the top of the blast hole), while the explosive composition is being placed into the blast hole. Thus, this may result in parts being segregated so that following placement of the composition within the blast hole, and on detonation, there may be a local or irregular explosion, this detracting from the efficiency of the composition.

Attempts have previously been made to overcome this problem such as by using a bonding agent, glue or adhesive in the explosive composition mixture, in an attempt to bind and hold the parts together. Such attempts have generally been unsuccessful, and have brought about many problems in the mixing and handling of explosive compositions. The use of bonding agents and adhesives makes mixing such as in mixing apparatus and the like, very difficult. For example, the bonding agent or adhesive often sticks to the surface of the mixing apparatus. Further, following mixing, the resultant product is sticky and difficult and unsatisfactory to handle.

Thus, in order to bind the parts of the composition together in a satisfactory manner, while overcoming the problems previously experienced, a binder has been developed which acts to bind and hold the parts one to the other, during mixing and placement, so as to avoid as far as possible, segregation and separation as experienced up until this time.

The binding or holding agent of the present invention is a water-in-oil emulsion, which is mixed with the parts of the explosive composition such as to cause the parts to be bound or held together without the disadvantages of glue or adhesive, while avoiding or minimising segregation.

In the preferred form of the invention the water-in-oil emulsion is a solution of oxidiser salts, for example nitrates or perchlorates which are emulsified and held in the disperse phase in oil. Preferably the oil phase is fuel oil, mineral oil, vegetable oil or any other appropriate oil or wax. It has been found for example that the grade of oil is not particularly important, provided that the oxidiser solution is able to be adequately emulsified into and remain as the disperse phase in the oil.

It has been found that this emulsion acts as a satisfactory and particularly effective binding and holding agent, in holding the parts of the dry mix composition together.

In one form of the invention the water-in-oil emulsion is added to an oxidiser portion of an explosive composition, such that the explosive composition contains an amount of up to 60% (by weight) water-in-oil binding emulsion.

The invention will now be described with reference to the accompanying examples.

EXAMPLE I

The dry mix explosive composition includes 68% (by weight) ammonium nitrate and 4% (by weight) fuel oil, added to which is 10% (by weight) bulking agent in the form of perlite. Water-in-oil emulsion, as a binder, is then added and mixed with the dry mix composition, in an amount of 20% (by weight).

EXAMPLE II

The dry mix explosive composition of this example includes 63% (by weight) ammonium nitrate, 2% (by weight) fuel oil and 15% (by weight) bulking agent in the form of vegetable protein matter. These are mixed together to form the dry mix composition, together with the 20% (by weight) water-in-oil emulsion which acts as a holding and binding agent holding the parts of the composition together.

EXAMPLE III

In this example the dry mix explosive composition includes 50% (by weight) ammonium nitrate, 5% (by weight) sodium nitrate, 8% (by weight) calcium nitrate, 3% (by weight) fuel oil and 15% (by weight) bulking agent in the form of sawdust. These are mixed together, in the presence of a binding or holding agent being a water-in-oil emulsion in the amount of 20% (by weight).

EXAMPLE IV

In this form of the invention the dry mix explosive composition includes 72% (by weight) ammonium nitrate, 3% (by weight) fuel oil and 10% (by weight) vermiculite acting as a bulking agent. These are mixed together in the presence of a water-in-oil emulsion which acts as a holding or binding agent. The water-in-oil emulsion is present in an amount of 15% (by weight).

EXAMPLE V

In this example the dry mix explosive composition includes 60% (by weight) ammonium nitrate, 4% (by weight) fuel oil, 10% (by weight) bulking agent (in the form of expanded polystyrene beads) and 20% (by weight) binding agent in the form of water-in-oil emulsion.

In the examples referred to above, the water-in-oil emulsion acts as a binding and holding agent, holding the parts of the explosive composition together. This then avoids or substantially minimises segregation of the parts during mixing, placement and the like.

It should be appreciated that the binding or holding agent, in the form of the water-in-oil emulsion, can be present in any appropriate amount, necessary to hold and bind the particles together to allow for appropriate handling, placement and the like. It is however envisaged that it is most appropriate to have the water-in-oil emulsion present in dry mix compositions, in an amount of up to approximately 60% (by weight).

It should be appreciated that the invention allows for parts of dry mix explosive compositions to be held together in order to overcome or minimise the problems associated with dry mix compositions used up until this time and as referred to hereinbefore.

It should be appreciated that the invention has been described by way of example only and that improvements and modifications may be made to the invention without departing from the scope thereof as defined by the appended claims.

We claim:

1. A dry mix explosive composition, including:

50–72% (by weight) ammonium nitrate;

2–4% (by weight) fuel oil;

10–15% (by weight) bulking agent; and

15–20% (by weight) of a water-in-oil emulsion, comprising a water-based solution of oxidizer salts held in a disperse phase in oil.

2. A composition as claimed in claim 1, wherein said oxidizer salts are nitrates or perchlorates.

3. A composition as claimed in claim 1, wherein said bulking agent is sawdust, foamed polystyrene beads, protein vegetable matter, perlite or vermiculite.

4. A composition as claimed in claim 1, wherein said oil phase in fuel oil, mineral oil or vegetable oil.

* * * * *